US011536431B2

(12) United States Patent
Shimizu

(10) Patent No.: US 11,536,431 B2
(45) Date of Patent: Dec. 27, 2022

(54) VEHICULAR LED LAMP HAVING IN HOUSING WITH TRANSPARENT COVER

(71) Applicant: KOITO MANUFACTURING CO., LTD., Tokyo (JP)

(72) Inventor: Hiroto Shimizu, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 17/422,366

(22) PCT Filed: Jan. 10, 2020

(86) PCT No.: PCT/JP2020/000760

§ 371 (c)(1),
(2) Date: Jul. 12, 2021

(87) PCT Pub. No.: WO2020/149245

PCT Pub. Date: Jul. 23, 2020

(65) Prior Publication Data

US 2022/0074563 A1 Mar. 10, 2022

(30) Foreign Application Priority Data

Jan. 18, 2019 (JP) ..... JP2019-006882
Jan. 18, 2019 (JP) ..... JP2019-006883

(51) Int. Cl.
*F21S 41/19* (2018.01)
*F21S 41/255* (2018.01)
(Continued)

(52) U.S. Cl.
CPC ..... *F21S 41/192* (2018.01); *F21S 41/255* (2018.01); *F21S 41/285* (2018.01); *F21S 45/48* (2018.01)

(58) Field of Classification Search
CPC ..... F21S 41/192; F21S 41/28; F21S 41/285; F21Y 2115/10; F21V 19/003; F21V 19/0035; F21V 17/06
See application file for complete search history.

(56) References Cited

U.S. PATENT DOCUMENTS 7,758,223 B2 * 7/2010 Osawa ..... F21V 9/08 362/240
9,068,712 B2 * 6/2015 Ting ..... F21S 41/19
(Continued)

FOREIGN PATENT DOCUMENTS

JP 2014-067515 A 4/2014
JP 2014-238984 A 12/2014
(Continued)

OTHER PUBLICATIONS

International Search Report for PCT/JP2020/000760 dated Feb. 25, 2020 [PCT/ISA/210].
(Continued)

*Primary Examiner* — Robert J May
(74) *Attorney, Agent, or Firm* — Sughrue Mion, PLLC

(57) ABSTRACT

A lamp (1) includes: a light source; a substrate (50) on which the light source is disposed; a housing (10) in which the substrate (50) is disposed; an electric cable (20) connected to the substrate (50), the electric cable (20) extending outward from the housing (10); and a thermally conductive sheet (40) having elasticity, the thermally conductive sheet (40) being sandwiched by a region in which the light source is disposed on the substrate (50) and the housing (10), in which the housing (10) has a recess (16) as a storage space in which the electric cable (20) is housed, at a position overlapping part of the substrate (50) out of the region in which the light source is disposed.

16 Claims, 7 Drawing Sheets

(51) Int. Cl.
*F21S 41/20* (2018.01)
*F21S 45/48* (2018.01)

(56) References Cited

U.S. PATENT DOCUMENTS

| | | | |
|---|---|---|---|
| 9,222,651 | B1 | 12/2015 | Vlad et al. |
| 2016/0079492 | A1 | 3/2016 | Ishimori et al. |

FOREIGN PATENT DOCUMENTS

| | | | |
|---|---|---|---|
| JP | 2016-058685 | A | 4/2016 |
| JP | 2016-134292 | A | 7/2016 |
| JP | 6308434 | B2 | 4/2018 |

OTHER PUBLICATIONS

Written Opinion for PCT/JP2020/000760 dated Feb. 25, 2020 [PCT/ISA/237].

* cited by examiner

VEHICULAR LED LAMP HAVING IN HOUSING WITH TRANSPARENT COVER

CROSS REFERENCE TO RELATED APPLICATIONS

This application is a National Stage of International Application No. PCT/JP2020/000760 filed Jan. 10, 2020, claiming priority based on Japanese Patent Application Nos. 2019-006882 filed Jan. 18, 2019 and 2019-006883 filed Jan. 18, 2019.

TECHNICAL FIELD

The present invention relates to a lamp and relates specifically to a lamp enabling downsizing with inhibition of deterioration in heat dissipation and a lamp that enables simultaneous achievement of a wide range of illumination and locally high illumination and requires no upsizing.

BACKGROUND ART

Known has been a lamp including a light source disposed in a housing. Patent Literature 1 discloses such a lamp. The lamp has a light emitting diode (LED) as a light source disposed on a substrate disposed in a housing integrally formed with a heat-dissipation fin. Heat from the LED in the lamp is conducted to the heat-dissipation fin through the substrate, so that the heat is dissipated from the heat-dissipation fin.

Known has been a lamp that achieves a wide range of illumination with diffusion and irradiation of light from a light source. Patent Literature 2 discloses such a lamp. For the lamp, light emitted from a plurality of light sources is diffused by a diffusing panel, resulting in emission from the lamp. Therefore, the lamp enables a wide range of illumination.

[Patent Literature 1] JP 2014-67515 A
[Patent Literature 2] JP 6308434 B2

SUMMARY OF INVENTION

A lamp according to a first aspect of the present invention, includes: a light source; a substrate on which the light source is disposed; a housing in which the substrate is disposed; an electric cable connected to the substrate, the electric cable extending outward from the housing; and a thermally conductive sheet having elasticity, the thermally conductive sheet being sandwiched by a region in which the light source is disposed on the substrate and the housing, in which the housing has a storage space in which the electric cable is housed, at a position overlapping part of the substrate out of the region in which the light source is disposed.

As above, because the lamp has the storage space in which the electric cable is housed, at the position overlapping the part of the substrate, the size in the principal-plane direction of the substrate of the lamp can be reduced, in comparison to a case where the electric cable is housed laterally to the substrate. In general, in a case where provided is a substrate on which a light source is disposed, the size in the principal-plane direction of the substrate affects the size of a lamp. Therefore, the lamp according to the present invention enables achievement of downsizing. As above, the lamp according to the present invention includes the thermally conductive sheet that has elasticity and is sandwiched by the region in which the light source is disposed on the substrate and the housing. Therefore, use of the elasticity of the thermally conductive sheet enables the thermally conductive sheet to be brought into closely contact with the region in which the light source is disposed on the substrate and the housing. In general, an electronic component largest in amount of heat generation in a lamp is a light source. Thus, the heat from the light source is conducted to the housing through the thermally conductive sheet in closely contact with the substrate and the housing, so that the heat can be dissipated from the housing. Therefore, the lamp according to the present invention enables inhibition of deterioration in heat dissipation.

In the lamp according to the first aspect, preferably, the housing is made of metal, the electric cable includes a ground, and the ground is connected to the housing in the storage space.

Such a configuration enables, even in a case where inrush current flows in the housing due to a cause of some kind, outward conduction of the inrush current from the lamp through the ground. Because the ground is connected to the housing in the storage space, the lamp can be downsized, in comparison to a case where the ground is connected to the housing out of the storage space.

Preferably, the lamp according to the first aspect further includes: an outer cover optically transparent, the outer cover covering at least the light source; and a holder secured to the housing, the holder having the outer cover secured to the holder, in which the holder is made of metal.

According to such a lamp, the outer cover can inhibit dust from entering the lamp. Because the holder that has the outer cover secured thereto and is secured to the housing is made of metal, the holder excels in thermal conduction, in comparison to a case where the holder is, for example, made of resin. Therefore, the heat of the housing can be more efficiently dissipated through the holder. Therefore, the lamp excels in heat dissipation. Note that, even in a case where the holder is secured to the housing, for example, through a seal, because of the holder made of metal, the heat conducted to the holder through the seal can be efficiently dissipated.

In the lamp according to the first aspect, preferably, the light source includes a plurality of first light sources, and the plurality of first light sources is disposed at least in pairs on the substrate such that the storage space is interposed between the plurality of first light sources.

Such a configuration causes the heat from the first light sources between which the storage space is interposed, to be conducted, respectively, to mutually opposed side faces of the storage space closer to the first light sources, so that the heat can be dissipated outward through both of the side faces. Thus, in comparison to a case where the first light sources are disposed only on one side of the storage space, heat can be inhibited from gathering to one side face of the storage space, resulting in efficient heat dissipation.

In this case, preferably, the light source includes at least one second light source, and the at least one second light source is disposed at least on one side of the substrate with respect to the storage space in a second direction perpendicular to a first direction of connecting the first light sources between which the storage space is interposed.

Such a configuration achieves further dispersed arrangement of the light source around the storage space. Therefore, heat can be further inhibited from gathering to one side face of the storage space, resulting in more efficient heat dissipation.

Furthermore, the storage space may be unevenly located on another side of a center of the substrate in the second direction, and the light source is not necessarily disposed on another side of the substrate with respect to the storage space in the second direction.

In the lamp according to the first aspect, preferably, an electronic component different from the light source is disposed, on the substrate, at a position overlapping the storage space.

The electronic component different from the light source, smaller in amount of heat generation than the light source is disposed at the position overlapping the storage space. Thus, deterioration in heat dissipation is inhibited, and the substrate requires no upsizing.

A lamp according to a second aspect of the present invention, includes: a first light source and a second light source; a housing in which the first light source and the second light source are disposed; an outer cover optically transparent, the outer cover being secured to the housing, the outer cover covering the first light source and the second light source; and a lens that reduces an angle of divergence of light to be transmitted, in which the outer cover is provided with a diffusion region that diffuses light to be transmitted and a non-diffusion region that inhibits diffusion of light to be transmitted, light emitted from the first light source is emitted through the diffusion region, and light emitted from the second light source is emitted through the lens and the non-diffusion region.

The lamp enables a wide range of illumination because the light from the first light source is emitted through the diffusion region of the outer cover. The light from the second light source is emitted through the lens that reduces the angle of divergence and the non-diffusion region of the outer cover, so that a local place can be illuminated. Because the first light source and the second light source are covered with a common outer cover, no upsizing is required, in comparison to a case where the first light source and the second light source are each covered with an individual outer cover. As above, the lamp according to the present invention enables achievement of a wide range of illumination and locally high illumination and requires no upsizing.

In the lamp according to the second aspect, preferably, lighting of the first light source and lighting of the second light source are performed simultaneously.

Such a configuration enables simultaneous achievement of a wide range of illumination and locally high illumination.

In the lamp according to the second aspect, preferably, the non-diffusion region is unevenly located with respect to a center of the outer cover, and a direction in which the light from the second light source is emitted from the outer cover is identical to a direction in which the non-diffusion region is unevenly located with respect to the center of the outer cover.

In a case where the non-diffusion region is provided at the center of the outer cover, even if the first light source is provided out of the center of the outer cover, the first light source and the non-diffusion region are close to each other. Thus, the light from the first light source is apt to leak from the non-diffusion region. Therefore, there is a tendency for light to be diffused difficult to emit efficiently. In contrast to this, in the configuration, the non-diffusion region is unevenly located with respect to the center of the outer cover. Thus, the first light source and the non-diffusion region are separated easily, so that the light from the first light source is inhibited easily from being emitted from the non-diffusion region. The light from the second light source is emitted in the direction in which the non-diffusion region is unevenly located with respect to the center of the outer cover. Thus, the emission direction of the light can be controlled easily, in comparison to a case where the light from the second light source is emitted in any direction different from the direction in which the non-diffusion region is unevenly located with respect to the center of the outer cover.

In this case, preferably, the non-diffusion region is provided in contact with an outer circumference of the outer cover.

Such a configuration enables maximally unevenly location of the non-diffusion region with respect to the center of the outer cover. Therefore, the light from the first light source can be further inhibited from being emitted from the non-diffusion region.

In the lamp according to the second aspect, as above, in a case where the light from the second light source is emitted from the outer cover in the direction in which the non-diffusion region is unevenly located with respect to the center of the outer cover, preferably, a direction of an optical axis of the lens is identical to the direction in which the light from the second light source is emitted from the outer cover.

In this case, even in a case where the second light source is assembled with a manufacturing error, the direction in which the second light source emits light can be corrected by the lens. Therefore, the second light source can be assembled easily.

In the lamp according to the second aspect, preferably, the first light source and the second light source are disposed on a common substrate.

In this case, the lamp can be further downsized, in comparison to a case where the first light source and the second light source are each disposed on an individual substrate.

In the lamp according to the second aspect, preferably, the diffusion region is larger in area than the non-diffusion region.

The diffusion region larger in area enables irradiation of a wider range of place.

In the lamp according to the second aspect, the lens may be disposed closer to the second light source than the outer cover is.

In this case, because the lens and the outer cover are provided separately, the direction of the optical axis of the lens can be adjusted more easily.

Alternatively, in the lamp according to the second aspect, the lens may be integrated with the non-diffusion region of the outer cover.

In this case, the lamp can be further downsized, in comparison to a case where the lens and the outer cover are provided separately.

DESCRIPTION OF EMBODIMENTS

Figure 1:
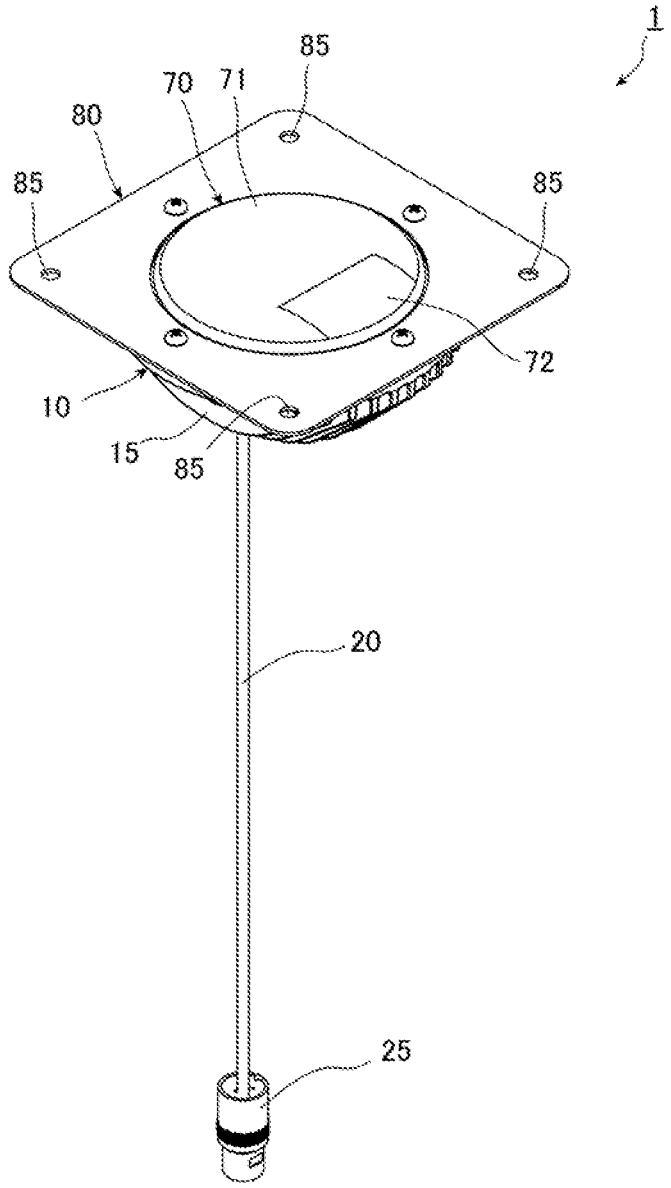
FIG. 1 is a front perspective view of a lamp according to a first embodiment of the present invention.

Embodiments of a lamp according to the present invention will be exemplified below with the accompanying drawings. The embodiments to be exemplified below are intended for easy understanding of the present invention. Thus, the present invention is not limited to the embodiments. Alternations and improvements may be made from the following embodiments without departing from the spirit of the present invention. Note that, for easy understanding, the dimensions of each member in the drawings for reference below are changed.

First Embodiment

The configuration of a lamp according to the present embodiment will be first described.

Figure 2:
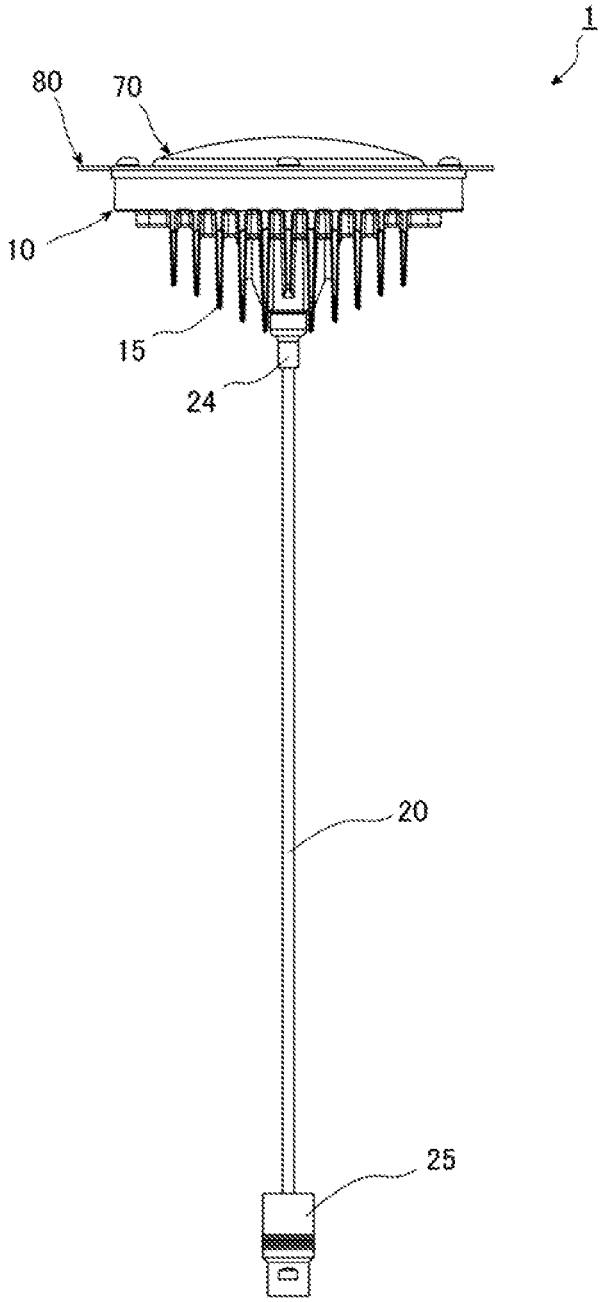
FIG. 2 is a side view of the lamp of FIG. 1.
Figure 3:
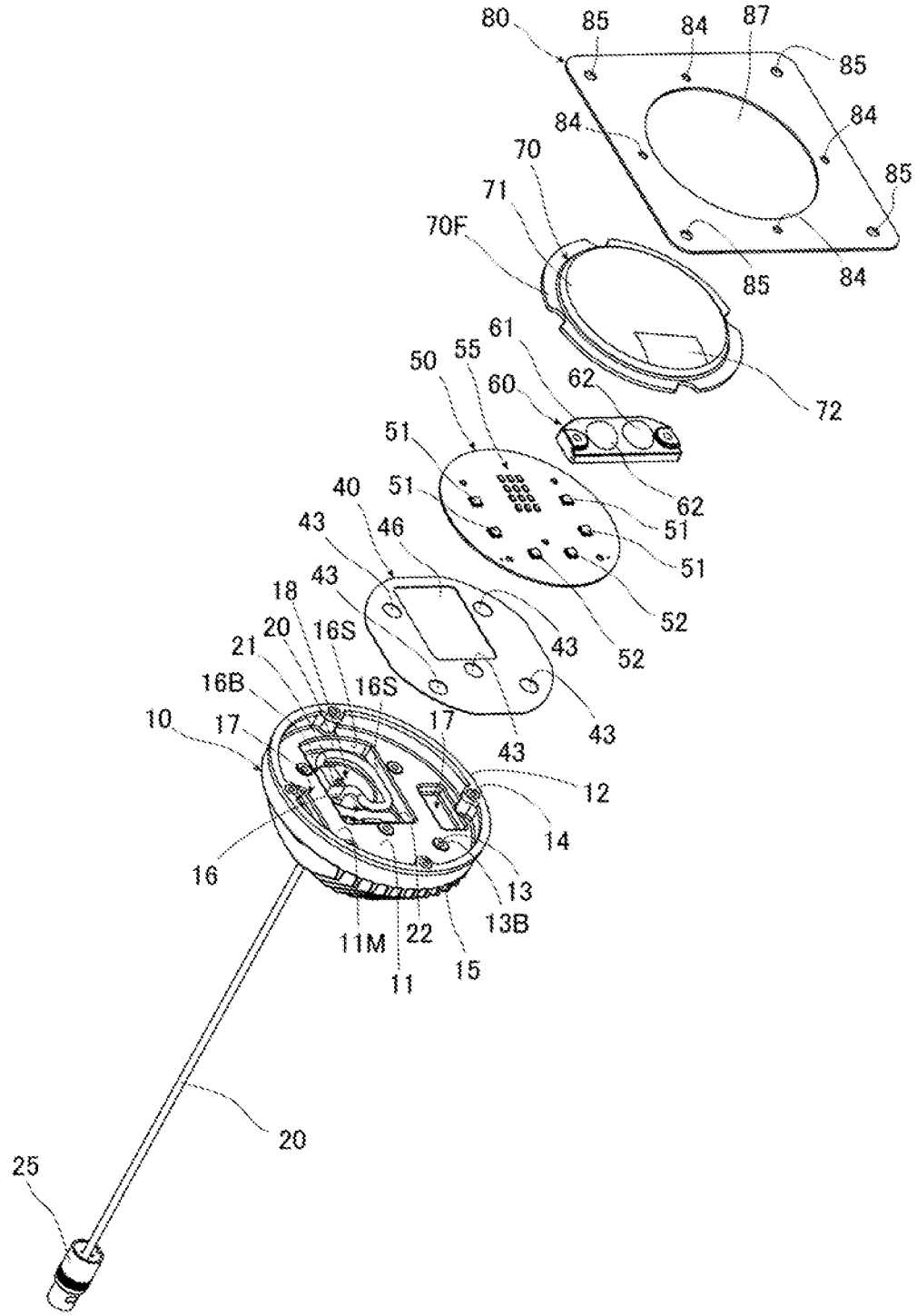
FIG. 3 is an exploded perspective view of the lamp of FIG. 1.

FIG. 1 is a front perspective view of the lamp according to the present embodiment. FIG. 2 is a side view of the lamp of FIG. 1. FIG. 3 is an exploded perspective view of the lamp of FIG. 1. As illustrated in FIGS. 1 to 3, the lamp 1 according to the present embodiment includes mainly a housing 10, an electric cable 20, a holder 80, a thermally conductive sheet 40, a substrate 50, a lens unit 60, and an outer cover 70.

Figure 4:
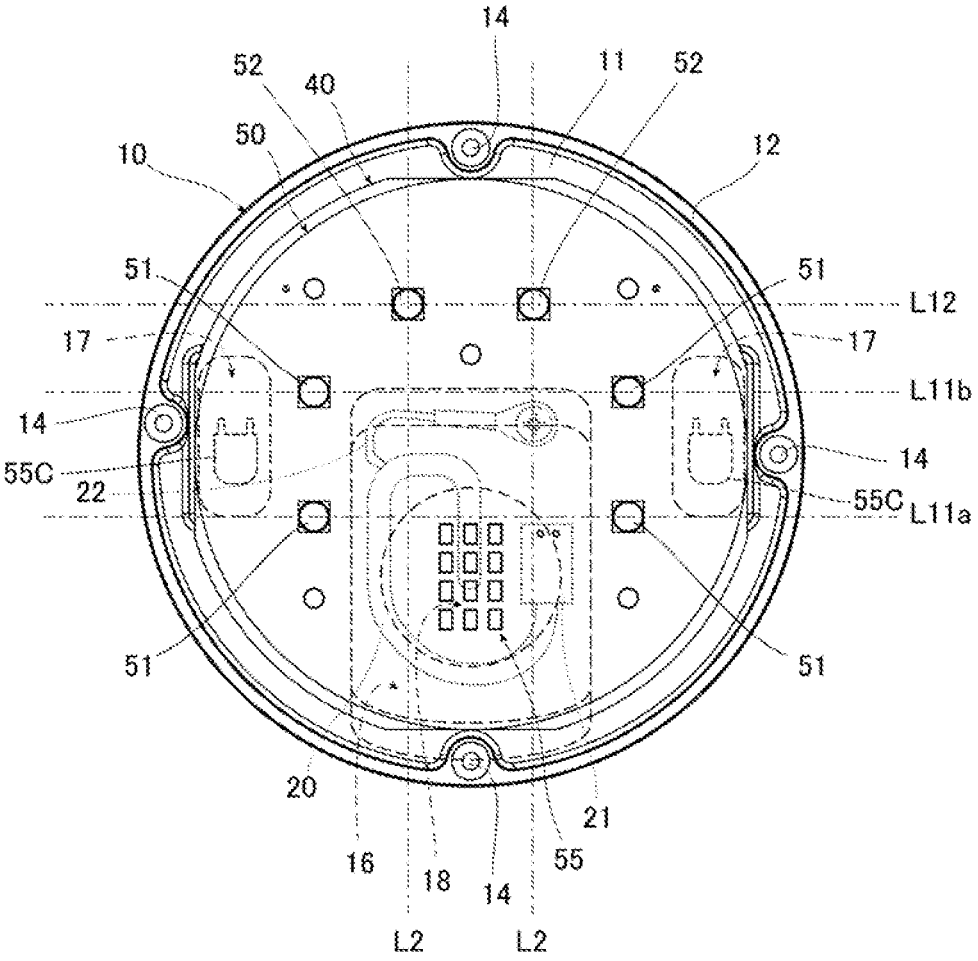
FIG. 4 is a front view of a housing in which a substrate is disposed.

FIG. 4 is a front view of the housing in which the substrate is disposed. The housing 10 is made of metal. In the present embodiment, the housing 10 is molded out of aluminum by die casting. Note that the housing 10 is not necessarily molded by such die casting and may be made of different metal. As illustrated in FIGS. 3 and 4, the housing 10 includes mainly a bottom wall 11, a side wall 12, and a plurality of heat-dissipation plates 15. The side wall 12 is substantially tubular and has one rim that is open and has threaded holes 14 at a plurality of places on the one rim. The threaded holes 14 are each intended for a screw for securing the housing 10 and the holder 80 together. The bottom wall 11 is connected to the other rim of the side wall 12. The bottom wall 11 has a main wall 11M that is substantially planar and has a recess 16 and a pair of recesses 17. The main wall 11M is provided with a plurality of bosses 13B. Each boss 13B has a threaded hole 13. The threaded holes 13 are each intended for a screw for securing the substrate 50 to the housing 10. Note that, in FIG. 3, for avoidance of complication of the drawing, only one threaded hole 14, one boss 13B, and one threaded hole 13 are denoted with reference signs.

The bottom wall 11 has a face closer to the side wall 12 and a face opposite thereto, in which the plurality of heat-dissipation plates 15 is connected to the opposite face. The heat-dissipation plates 15 extend mutually in parallel at regular intervals from the bottom wall 11. The heights of the heat-dissipation plates 15 increase toward the center of the bottom wall 11.

Each recess 17, with which the bottom wall 11 is provided, is substantially rectangular in front view. The pair of recesses 17 is opposed to each other at ends of the bottom wall 11, overlapping a straight line passing through substantially the center of the bottom wall 11. The recesses each house an electronic component disposed on the substrate 50 as described below.

Figure 5:
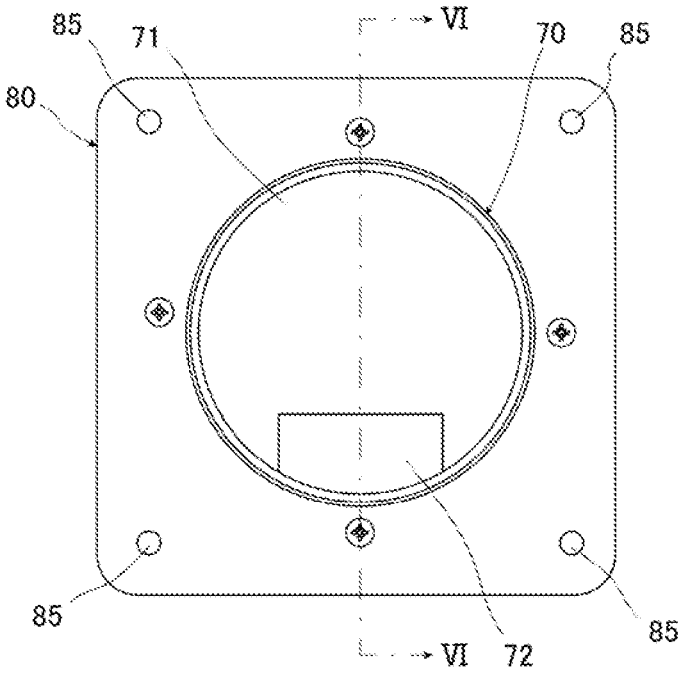
FIG. 5 is a front view of the lamp of FIG. 1.
Figure 6:
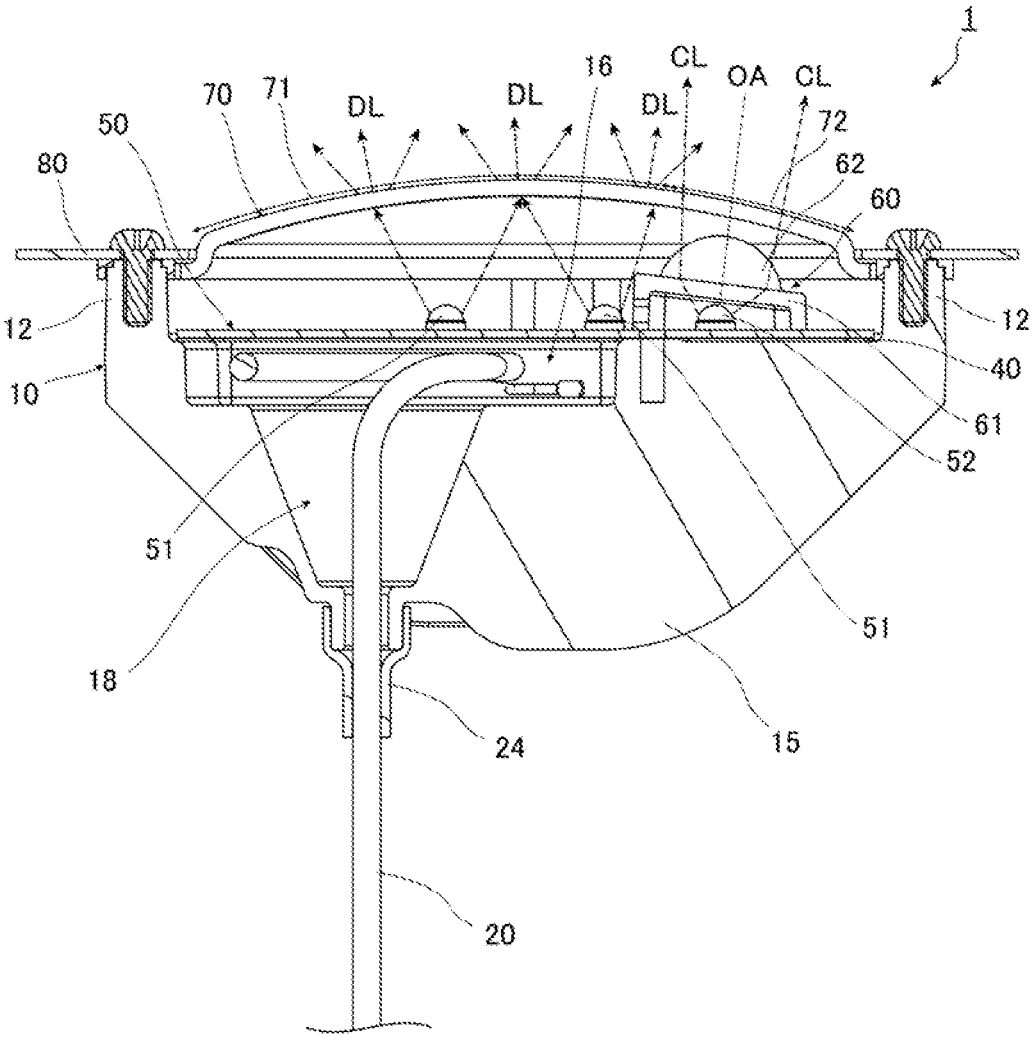
FIG. 6 is a sectional view taken along line VI-VI of FIG. 5.

The recess 16, with which the bottom wall 11 is provided, is unevenly located with respect to the center of the bottom wall 11. The recess 16 has side-wall portions 16S and a bottom-wall portion 16B. The recess 16 is substantially rectangular in front view and has one side arcing along the side wall 12. Therefore, three side-wall portions 16S among the plurality of side-wall portions 16S that the recess 16 has are substantially planar and the other side-wall portion 16S curves along the side wall 12. FIG. 5 is a front view of the lamp of FIG. 1. FIG. 6 is a sectional view taken along line VI-VI of FIG. 5. For example, as illustrated in FIGS. 3, 4, and 6, the bottom-wall portion 16B is provided with a recess 18 truncated-conical. That is, the recess 16, with which the bottom wall 11 is provided, has a shape in which a substantially rectangular-parallelepiped space and a truncated-conical space are connected together. The recess 18 truncated-conical has a bottom portion having a hole in communication with the outside of the housing 10. The hole is intended for insertion of the electric cable 20 from outside the housing 10 into the housing 10.

The electric cable 20 includes a plurality of power lines and a ground 22. As illustrated in FIG. 6, the electric cable 20 extends outward from the inside of the housing 10 through the hole with which the bottom portion of the recess 18 truncated-conical is provided in the housing 10. As illustrated in FIGS. 3 and 4, a connector 21 is connected to the end of the electric cable 20 in the housing 10. The plurality of power lines is connected to the terminal of the connector 21. The connector 21 is connected to the substrate 50 as described below. In the recess 16, the ground 22 is connected and secured to the housing 10 with a screw, separately from the power lines. Thus, the ground 22 and the housing 10 are electrically connected together. The portion of the electric cable 20 located in the housing 10 is disposed in the recess 16 including the recess 18, with the substrate 50 disposed. That is, the recess 16 including the recess 18 serves as a storage space in which the electric cable 20 is housed. Note that, for example, as illustrated in FIG. 2, a boot 24 is fitted to the housing 10 outside the housing 10, and the portion of the electric cable 20 inserted in the housing 10 is inserted through the boot 24. The end of the electric cable 20 outside the housing 10 is provided with a connector 25 for connection with a different device.

The thermally conductive sheet 40 has elasticity and insulation, and excels in thermal conduction. In the present embodiment, a silicon-resin sheet is used as a heat-transfer sheet. As illustrated in FIG. 3, the thermally conductive sheet 40 has an outer form almost along the side wall 12. In the present embodiment, the outer form is substantially circular. The thermally conductive sheet 40 has a plurality of circular openings 43 for penetration of the bosses 13B with which the bottom wall 11 of the housing 10 is provided and has a substantially rectangular opening 46 at a position overlapping the recess 16 as the storage space for the electric cable 20. Therefore, with the thermally conductive sheet 40 disposed on the bottom wall 11 of the housing 10, the bosses 13B of the housing 10 protrude from the openings 43 and the recess 16 is exposed from the opening 46. The thermally conductive sheet 40 disposed on the bottom wall 11 of the housing 10 is sandwiched by the portion out of the regions in which the recesses 16 and 17 and the bosses 13B of the housing 10 are provided and the substrate 50. Note that the thermally conductive sheet 40 has no openings in regions overlapping the recesses 17. However, the recesses 17 are recessed from the main wall 11M. Thus, the regions of the thermally conductive sheet 40 that overlaps the recesses 17 are not sandwiched by the substrate 50 and the housing 10.

The substrate 50 is, for example, a glass epoxy substrate or ceramic substrate having wiring thereon. A plurality of light sources is disposed on the surface of the substrate 50. An electronic component 55 including no light source is disposed on at least one of the surface and the back face. In the present embodiment, the electronic component 55 including no light source is implemented in a dual-sided manner. The substrate 50 has an outer form almost along the side wall 12. In the present embodiment, the outer form of the substrate 50 is substantially the same as the circular outer form of the thermally conductive sheet 40. The substrate 50 is disposed in the housing 10 such that the back face faces toward the bottom wall 11 of the housing 10. As above, the recess 16 is unevenly located with respect to the center of the region surrounded by the side wall 12. Thus, with the substrate 50 disposed in the housing 10, the recess 16 is unevenly located with respect to the center of the substrate 50. With the substrate 50 disposed on the bottom wall 11 of the housing 10 through the thermally conductive sheet 40, the substrate 50 and the housing 10 are secured with a plurality of screws, so that, as above, the thermally conductive sheet 40 is sandwiched by the substrate 50 and the housing 10.

The plurality of light sources disposed on the surface of the substrate 50 includes a plurality of first light sources 51 and a plurality of second light sources 52. In the present embodiment, the first light sources 51 are the same in configuration as the second light sources 52. In the present embodiment, the first light sources 51 and the second light sources 52 each emit light such that the optical axis is oriented in the normal direction of the substrate 50. The first light sources 51 are disposed at least in pairs such that the region of the substrate 50 overlapping the recess 16 is interposed therebetween.

As illustrated in FIG. 4, in the present embodiment, on the substrate 50, a pair of first light sources 51 is disposed on a straight line L11*a* that extends along a first direction perpendicular to the direction in which the recess 16 is unevenly located with respect to the center of the substrate 50 and passes by the center of the recess 16, so that the recess 16 is interposed between the pair of first light sources 51. In other words, the first direction is the direction of connecting the first light sources 51 between which the storage space is interposed. In the present embodiment, on the substrate 50, another pair of first light sources 51 is disposed on a straight line L11*b* that extends along the first direction and almost overlaps a side-wall portion 16S planar of the recess 16. Note that, along the first direction, the pair of recesses 17 is closer to the outer circumference in arrangement position than the first light sources 51 are and is provided by the side wall 12. Therefore, the recesses 17 do not overlap the first light sources 51.

On the substrate 50, the second light sources 52 are each disposed on one side of the recess 16 opposite to the direction in which the recess 16 is unevenly located with respect to the center of the substrate 50, on a straight line L2 extending along a second direction perpendicular to the first direction. The second direction is along the direction in which the recess 16 is unevenly located with respect to the center of the substrate 50. Thus, the second light sources 52 are disposed on the opposite side to the side on which the recess 16 is unevenly located with respect to the center of the substrate 50 in the second direction, side by side with the recess 16. In the present embodiment, the pair of second light sources 52 is disposed on a straight line L12 that extends along the first direction and passes on the above one side of the recess 16. Note that, in the present embodiment, no light source is disposed on the other side with respect to the recess 16 in the second direction.

As above, in the first direction, disposed is each pair of first light sources 51 between which the recess 16 is interposed. In the second direction, the second light sources 52 are disposed side by side with the recess 16. Furthermore, as above, the thermally conductive sheet 40 is sandwiched by any region out of the regions in which the recesses 16 and 17 and the bosses 13B of the housing 10 are provided and the substrate 50. Therefore, the thermally conductive sheet 40 is sandwiched by at least the regions in which the light sources are disposed on the substrate 50 and the bottom wall 11 of the housing 10.

The electronic component 55 including no light source, disposed on the substrate 50 includes, for example, a rectifier circuit, a constant current circuit, and a socket. At least part of the electronic component 55 is disposed at the position of the substrate 50 that overlaps the recess 16. The socket serves as a component for connection with the connector 21 with which the power lines of the electric cable 20 are provided. Although no particular illustration is given, the socket is disposed on the back face that is a face closer to the recess 16, at the position of the substrate 50 that overlaps the recess 16, in connection with the connector 21 provided at the end of the power lines of the electric cable 20. At the position of the back face of the substrate 50 that overlaps each recess 17, for example, disposed is an electronic component 55C serving as at least part of the constant current circuit. With the substrate 50 disposed in the housing 10, the electronic component 55C is disposed in the recess 17.

As illustrated in FIGS. 3 and 6, the lens unit 60 is disposed such that the second light sources 52 of the substrate 50 are covered therewith. The lens unit 60 includes a base 61 and a pair of lenses 62 integrally molded with the base 61. With the lens unit 60 disposed on the surface of the substrate 50, the lenses 62 each cover the corresponding second light source 52, and each lens 62 almost focuses on the second light source 52. Therefore, the light emitted from each second light source 52 enters the corresponding lens 62. Each lens 62 is a convex lens and reduces the angle of divergence of incident light. With respect to the normal direction of the surface of the substrate 50, the optical axis OA of each lens 62 slants to the opposite direction to the direction in which the recess 16 is unevenly located with respect to the center of the substrate 50. Therefore, the light from the corresponding second light source 52 emitted through each lens 62 propagates away from the normal of the substrate 50 that passes through the center of the substrate 50, at an angle of divergence smaller than the angle of divergence of the light emitted from the second light source 52.

The outer cover 70 is secured to the holder 80. The holder 80 is a member of a flat plate made of metal. In the present embodiment, as illustrated in FIGS. 3 and 5, the holder 80 has an outer form substantially square and has a threaded hole 85 for attachment of the lamp 1 to a structure, such as a wall, near each apex. Therefore, the holder 80 secures the lamp 1 to a structure, such as a wall, in addition to securing the outer cover 70. The holder 80 has a circular opening 87 at the center. The circular opening 87 is smaller than the inner circumferential face of the side wall 12 of the housing 10 and is substantially the same in shape and size as the circular outer form of the substrate 50. The outer cover 70 fits to the opening 87. Around the opening 87, provided is a plurality of threaded holes 84 identical in position to the threaded holes 14 with which the side wall 12 of the housing 10 is provided.

The outer cover 70 is formed of an optically transparent material. A flange 70F is connected to the outer circumference of the outer cover 70. The outer cover 70 with the outer circumference substantially circular is centroclinal. The outer circumference of the outer cover 70 is slightly smaller in size than the opening 87 of the holder 80. The outer cover 70 centroclinal fits to and protrudes from the opening 87 of the holder 80. The flange 70F extends outward from the outer circumference of the outer cover 70. The flange 70F adheres around the opening 87 of the holder 80, so that the outer cover 70 is secured to the holder 80. Note that the flange 70F does not cover the positions of the threaded holes 84.

Screws are inserted from the threaded holes 84 of the holder 80 to which the outer cover 70 is secured as above to the threaded holes 14 of the housing 10, so that the housing 10 is secured to the holder 80. Note that a seal may be interposed between the housing 10 and the holder 80 in order to inhibit any gap from occurring between the housing 10 and the holder 80. Thus, the outer cover 70 is secured to the housing 10 through the holder 80, so that the outer cover 70 covers each second light source 52 together with the corresponding lens 62, in addition to covering each first light source 51. Therefore, each lens 62 covering the corresponding second light source 52 is closer to the second light source 52 than the outer cover 70 is. With the outer cover 70 secured to the housing 10 as above, the center of the substrate 50 and the center of the outer cover 70 are substantially identical to each other.

For example, as illustrated in FIG. 5, the outer cover 70 includes a diffusion region 71 and a non-diffusion region 72. The diffusion region 71 has asperity, due to, for example, graining, on the back face that is a face closer to the substrate 50, in order to scatter light. Therefore, the diffusion region 71 scatters light to be transmitted. The non-diffusion region 72 is a clear region in which the surface has asperity reduced as much as possible. Therefore, the non-diffusion region 72 allows light to be substantially transmitted, to pass therethrough with inhibition of diffusion.

In the present embodiment, the diffusion region 71 is larger in area than the non-diffusion region 72. With the outer cover 70 attached to the housing 10 through the holder 80, the diffusion region 71 covers each first light source 51 and the non-diffusion region 72 covers each lens 62. As above, the second light sources 52 are disposed on the opposite side to the side on which the recess 16 is unevenly located with respect to the center of the substrate 50, and the center of the substrate 50 and the center of the outer cover 70 are substantially identical to each other. Thus, the non-diffusion region 72 is unevenly located with respect to the center of the outer cover 70, on the opposite side to the side on which the recess 16 is unevenly located. In the present embodiment, the non-diffusion region 72 is in contact with the outer circumference of the outer cover 70. Due to the diffusion region 71 and the non-diffusion region 72 provided as above, the light emitted from each first light source 51 is emitted from the lamp 1 through the diffusion region 71, and the light emitted from each second light source 52 is emitted from the lamp 1 through the corresponding lens 62 and the non-diffusion region 72.

Next, the operation of the lamp 1 according to the present embodiment will be described.

When predetermined power is applied to a signal cable of the electric cable 20 due to a switch not illustrated, current flows into each first light source 51 and each second light source 52 through the substrate 50, so that light is emitted from each first light source 51 and each second light source 52. In the present embodiment, the first light sources 51 are the same in configuration as the second light sources 52, and the current that flows in each first light source 51 is substantially the same in level as the current that flows in each second light source 52. Therefore, the light that each first light source 51 emits is substantially the same in intensity as the light that each second light source 52 emits. In the present embodiment, the first light sources 51 and the second light sources 52 each emit light such that the optical axis is oriented in the normal direction of the principal plane of the substrate 50.

The light emitted from each first light source 51 enters the diffusion region 71 of the outer cover 70, and then diffused light DL is emitted from the outer cover 70. The light emitted from each second light source 52 is emitted from the lens 62 along the direction of the optical axis of the lens 62, with a small angle of divergence due to the lens 62. The light emitted from each lens 62 enters the non-diffusion region 72 of the outer cover 70 and then light CL inhibited from being diffused is emitted from the outer cover 70, so that a wide range is illuminated with the light.

As above, the non-diffusion region 72 is unevenly located with respect to the center of the outer cover 70, on the opposite side to the side on which the recess 16 is unevenly located. Thus, with respect to the center of the substrate 50 and the center of the outer cover 70, the second light sources 52 and the non-diffusion region 72 are unevenly located on the opposite side to the side on which the recess 16 is unevenly located. Furthermore, as above, the optical axis OA of each lens 62 slants to the opposite side to the side on which the recess 16 is unevenly located. Therefore, the light CL from each second light source 52, emitted from the non-diffusion region 72 through the lens 62 is emitted in the direction in which the non-diffusion region 72 is unevenly located with respect to the center of the outer cover 70. The light CL from each second light source 52, emitted from the non-diffusion region 72 has a small angle of divergence due to the lens 62 and is inhibited from being diffused, resulting in local illumination.

Next, the function and effect of the lamp 1 according to the present embodiment will be described.

In a case where power is supplied to a light source of a lamp, in general, an electric cable extending outward from the lamp is connected to a substrate disposed on a housing, and then power is supplied from outside the lamp to the light source through the electric cable and the substrate. In a case where such a lamp is assembled, in some cases, the substrate spaced apart from the housing and the electric cable are connected together, and then the substrate is disposed on the housing. In this case, the electric cable is partially surplus with the substrate disposed on the housing, and thus the surplus electric cable is housed in any place in the housing. For the lamp disclosed in Patent Literature 1, the arrangement of such a surplus electric cable has not been examined. If the electric cable is housed in the housing, the electric cable requires disposing in a lateral space to the substrate. Thus, the lamp disclosed in Patent Literature 1 tends to increase in size. However, due to recent diversification in design, there is a demand for downsizing of lamps.

Meanwhile, downsizing of a lamp is likely to cause deterioration in heat dissipation.

A lamp 1 according to a first aspect of the present embodiment includes a first light source 51, a second light source 52, a substrate 50 on which the first light source 51 and the second light source 52 are disposed, a housing 10 in which the substrate 50 is disposed, an electric cable 20 that is connected to the substrate 50 and extends outward from the housing 10, and a thermally conductive sheet 40 that has elasticity and is sandwiched by the regions in which the first light source 51 and the second light source 52 are disposed on the substrate 50 and the housing 10. The housing 10 has a recess 16 as a storage space in which the electric cable 20 is housed, at a position overlapping part of the substrate 50 out of the regions in which the first light source 51 and the second light source 52 are disposed.

As above, because the lamp 1 has the recess 16 as a storage space in which the electric cable 20 is housed, at the position overlapping the part of the substrate 50, the size in the principal-plane direction of the substrate 50 of the lamp 1 can be reduced, in comparison to a case where the electric cable 20 is housed laterally to the substrate 50. In general, in a case where provided is a substrate on which a light source is disposed, the size in the principal-plane direction of the substrate affects the size of a lamp. Therefore, the lamp 1 according to the present embodiment enables achievement of downsizing. As above, the lamp 1 according to the present embodiment includes the thermally conductive sheet 40 that has elasticity and is sandwiched by the regions in which the first light source 51 and the second light source 52 are disposed on the substrate 50 and the housing 10. Therefore, use of the elasticity of the thermally conductive sheet enables the thermally conductive sheet 40 to be brought into closely contact with the regions in which the first light source 51 and the second light source 52 are disposed on the substrate 50 and the housing 10. In general, an electronic component largest in amount of heat generation in a lamp is a light source. Thus, the heat from the first light source 51 and the second light source 52 is conducted to the housing 10 through the thermally conductive sheet 40 in closely contact with the substrate 50 and the housing 10, so that the heat can be dissipated from the housing 10. Therefore, the lamp 1 according to the present embodiment enables inhibition of deterioration in heat dissipation. That is, the lamp 1 according to the present embodiment enables downsizing with inhibition of deterioration in heat dissipation.

In the present embodiment, the housing 10 is made of metal. The electric cable 20 includes a ground 22. The ground 22 is connected to the housing 10 in the recess 16 as a storage space. Therefore, even in a case where inrush current flows in the housing 10 due to a cause of some kind, the inrush current can be conducted outward from the lamp 1 through the ground 22. Because the ground 22 is connected to the housing 10 in the recess 16, the lamp 1 can be downsized, in comparison to a case where the ground 22 is connected to the housing 10 out of the recess 16. The housing 10 made of metal enables more efficient dissipation of the heat conducted from the first light source 51 and the second light source 52 to the housing 10.

The lamp 1 according to the present embodiment includes a holder 80 that is secured to the housing 10 and has an outer cover 70 secured thereto, in which the holder 80 is made of metal. Therefore, in comparison to a case where the holder 80 is, for example, made of resin, the holder 80 excels in thermal conduction. Thus, the lamp 1 enables more efficient heat dissipation of the housing 10 through the holder 80, exceling in heat dissipation. Note that, even in a case where the holder 80 is secured to the housing 10, for example, through a seal, because of the holder 80 made of metal, the heat conducted to the holder 80 through the seal can be efficiently dissipated.

The lamp 1 according to the present embodiment includes a plurality of first light sources 51 disposed at least in pairs on the substrate 50 such that the recess 16 as a storage space is interposed between the plurality of first light sources 51. Therefore, the heat from each first light source 51 is conducted to the corresponding one of a pair of mutually opposed side-wall portions 16S of the recess 16, resulting in outward heat dissipation through both of the side-wall portions 16S. Thus, in comparison to a case where the first light sources 51 are disposed only on one side of the recess 16, heat can be inhibited from gathering to one side-wall portion 16S of the recess 16, resulting in efficient heat dissipation.

Furthermore, in the lamp 1 according to the present embodiment, the second light source 52 is disposed at least on one side of the substrate 50 with respect to the recess 16 in a second direction perpendicular to a first direction of connecting the first light sources 51 between which the recess 16 is interposed. Thus, the light sources are disposed around the recess 16 with further dispersion. Therefore, heat can be further inhibited from gathering to one side-wall portion 16S of the storage space, resulting in more efficient heat dissipation.

In the lamp 1 according to the present embodiment, an electronic component 55 including no light source is disposed, on the substrate 50, at a position overlapping the recess 16. The electronic component 55 including no light source, smaller in amount of heat generation than the light sources is disposed at the position overlapping the recess 16. Thus, deterioration in heat dissipation is inhibited, and the substrate 50 requires no upsizing.

There is a demand for a wide range of illumination and locally high illumination of a lamp. For example, there is a demand for a wide range of illumination for grasping of the entire arrangement of things and locally high illumination for recognition of characters or particular working at a brightly illuminated position.

In general, in order to meet such a demand, a lamp for a wide range of illumination and a lamp for locally high illumination require preparing. Thus, the entire lamp is likely to increase in size.

A lamp 1 according to a second aspect of the present embodiment includes a first light source 51, a second light source 52, a housing 10 in which the first light source 51 and the second light source 52 are disposed, an optically transparent outer cover 70 that is secured to the housing 10 and covers the first light source 51 and the second light source 52, and a lens 62 that reduces the angle of divergence of light to be transmitted. The outer cover 70 is provided with a diffusion region 71 that diffuses light to be transmitted and a non-diffusion region 72 that inhibits diffusion of light to be transmitted. The light emitted from the first light source 51 is emitted through the diffusion region 71, and the light emitted from the second light source 52 is emitted through the lens 62 and the non-diffusion region 72.

The lamp 1, having such a configuration, according to the present embodiment enables a wide range of illumination because the light from the first light source 51 is emitted through the diffusion region 71. The light from the second light source 52 is emitted through the lens 62 and the non-diffusion region 72, so that a local place can be illuminated. Because the first light source 51 and the second light source 52 are covered with a common outer cover 70, no upsizing is required, in comparison to a case where the first light source 51 and the second light source 52 are each covered with an individual outer cover. As above, the lamp 1 according to the present embodiment enables achievement of a wide range of illumination and locally high illumination and requires no upsizing.

In the lamp 1 according to the present embodiment, lighting of the first light source 51 and lighting of the second light source 52 are performed simultaneously. Therefore, a wide range of illumination and locally high illumination can be simultaneously achieved.

In the lamp 1 according to the present embodiment, the non-diffusion region 72 is unevenly located with respect to the center of the outer cover 70. The direction in which the light from the second light source 52 is emitted from the outer cover 70 is identical to the direction in which the non-diffusion region 72 is unevenly located with respect to the center of the outer cover 70. In a case where the non-diffusion region 72 is provided at the center of the outer cover 70, even if the first light source 51 is provided out of the center of the outer cover 70, the first light source 51 and the non-diffusion region 72 are close to each other. Thus, the light from the first light source 51 is apt to leak from the non-diffusion region 72. Therefore, there is a tendency for light to be diffused difficult to emit efficiently. In contrast to this, in the lamp 1 according to the present embodiment, the non-diffusion region 72 is unevenly located with respect to the center of the outer cover 70. Thus, the first light source 51 and the non-diffusion region 72 are separated easily, so that the light from the first light source 51 is inhibited easily from being emitted from the non-diffusion region 72. The light from the second light source 52 is emitted in the direction in which the non-diffusion region 72 is unevenly located with respect to the center of the outer cover 70. Thus, the emission direction of the light can be controlled easily, in comparison to a case where the light from the second light source 52 is emitted in any direction different from the direction in which the non-diffusion region 72 is unevenly located with respect to the center of the outer cover 70.

Furthermore, in the lamp 1 according to the present embodiment, the non-diffusion region 72 is provided in contact with the outer circumference of the outer cover 70. Thus, the non-diffusion region 72 can be maximally unevenly located with respective to the center of the outer cover 70. Therefore, the light from the first light source 51 can be further inhibited from being emitted from the non-diffusion region 72.

In the lamp 1 according to the present embodiment, the direction of the optical axis of the lens 62 is identical to the direction in which the light from the second light source 52 is emitted from the outer cover 70. Thus, even in a case where the second light source 52 is assembled with a manufacturing error, the direction in which the second light source 52 emits light can be corrected by the lens 62. Therefore, the second light source 52 can be assembled easily.

In the lamp 1 according to the present embodiment, the first light source 51 and the second light source 52 are disposed on a common substrate 50. Thus, the lamp 1 can be further downsized, in comparison to a case where the first light source 51 and the second light source 52 are each disposed on an individual substrate.

In the lamp 1 according to the present embodiment, the diffusion region 71 is larger in area than the non-diffusion region 72. Thus, a wider range of place can be irradiated.

In the lamp 1 according to the present embodiment, the lens 62 is disposed closer to the second light source 52 than the outer cover 70 is. That is, the lens 62 and the outer cover 70 are provided separately. Thus, the direction of the optical axis of the lens 62 can be adjusted more easily.

Second Embodiment

Next, a second embodiment of the present invention will be described in detail with reference to FIG. 7. Note that, unless otherwise noted, constituent elements the same as or similar to those according to the first embodiment are denoted with the same reference signs, and the duplicate description thereof will be omitted.

Figure 7:
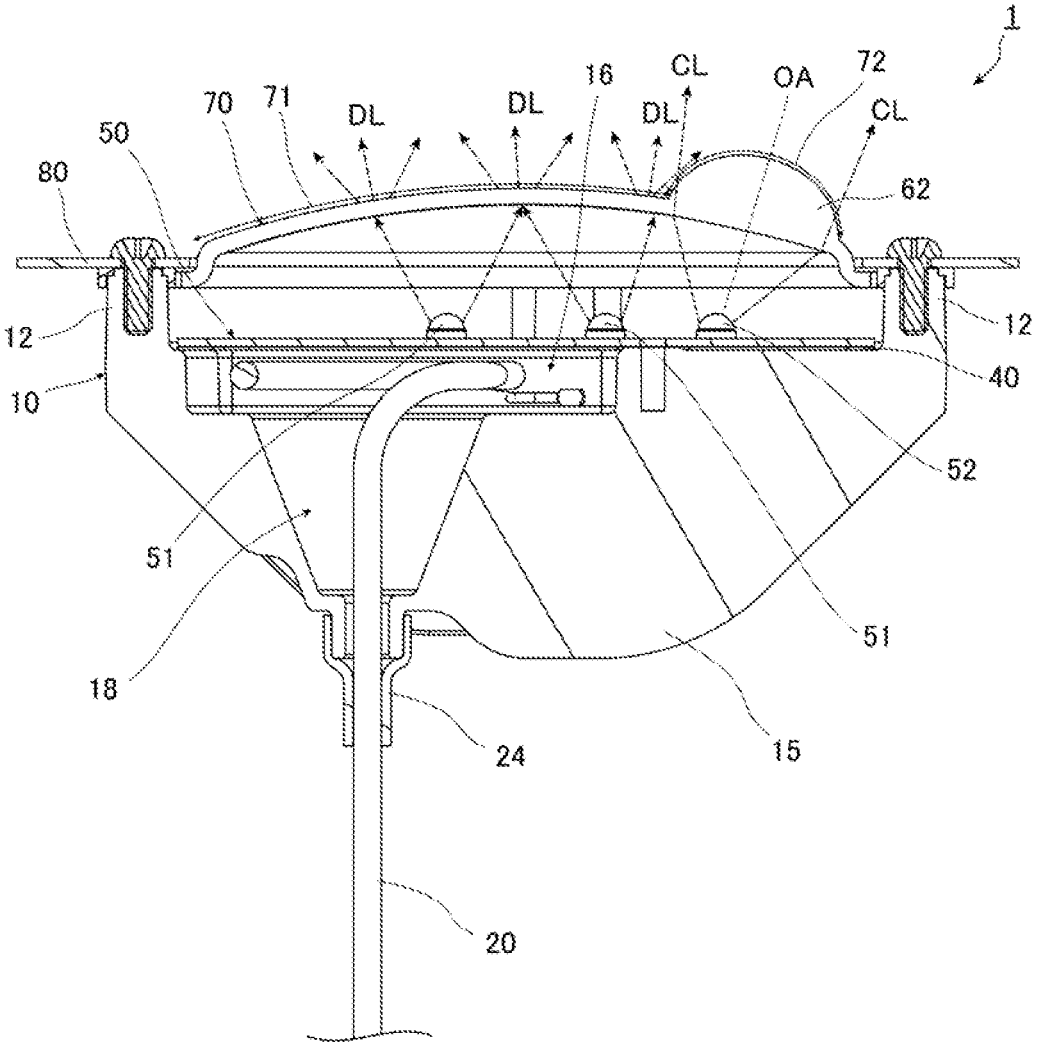
FIG. 7 illustrates a lamp according to a second embodiment of the present invention, similarly to FIG. 6.

FIG. 7 illustrates a lamp according to the present embodiment, similarly to FIG. 6. The lamp 1 according to the present embodiment is different from the lamp 1 according to the first embodiment in that lenses 62 are integrated with an outer cover 70. Specifically, in the present embodiment, the lenses 62 are provided in a non-diffusion region 72. In the present embodiment, with a lens unit 60 disposed on the surface of a substrate 50, each lens 62 covers an individual second light source 52, and each lens 62 almost focuses on the second light source 52. In the present embodiment, with respect to the normal direction of the surface of the substrate 50, the optical axis OA of each lens 62 slants to the opposite direction to the direction in which a recess 16 is unevenly located with respect to the center of the substrate 50. The light from the corresponding second light source 52 emitted from each lens 62 propagates away from the normal of the substrate 50 that passes through the center of the substrate 50, at an angle of divergence smaller than the angle of divergence of the light emitted from the second light source 52.

The lamp 1 according to the present embodiment enables a simpler lamp configuration, in comparison to a case where the lenses 62 and the outer cover 70 are provided separately as in the lamp 1 according to the first embodiment. Because no lenses 62 are disposed between a housing 10 and the outer cover 70, bringing the outer cover 70 closer to the housing 10 enables downsizing of the lamp 1.

The embodiments of the present invention have been exemplarily described above. However, the present invention is not limited to the embodiments.

For example, in each embodiment, the housing 10 is made of metal. However, the housing 10 is not necessarily made of metal. Note that, from the viewpoint of release of inrush current occurring in the housing 10 through the ground 22 and the viewpoint of advantage in heat dissipation, preferably, the housing 10 is made of metal.

In each embodiment, the ground 22 is not necessarily essential. As above, from the viewpoint of release of inrush current occurring in the housing 10 through the ground 22, preferably, the lamp 1 includes the ground 22 connected to the housing 10. Note that the position of connection of the ground 22 to the housing 10 is not necessarily in the recess 16 as a storage space. Note that, from the viewpoint of possible avoidance of upsizing, preferably, the ground 22 is connected to the housing 10 in the recess 16.

From the viewpoint of the lamp according to the first aspect, the outer cover 70 is not necessarily required. Note that, from the viewpoint of inhibition of dust from adhering to, for example, a light source, preferably, the outer cover 70 is provided. The holder 80 is not necessarily essential. Even in a case where the holder 80 is provided, the holder 80 is not necessarily made of metal. Note that, from the viewpoint of advantage in thermal conduction, preferably, the holder 80 is made of metal.

From the viewpoint of the lamp according to the first aspect, only the first light sources 51 or the second light sources 52 may be provided as light sources. Note that, from the viewpoint of emission of diffused light DL from the diffusion region 71 of the outer cover 70 and emission of light CL inhibited from being diffused from the non-diffusion region 72, preferably, the lamp 1 includes the first light sources 51 and the second light sources 52.

The number of first light sources 51 may be one or at least three. The first light sources 51 are not necessarily disposed such that the recess 16 as a storage space is interposed therebetween, and thus may be disposed only on one side of the recess 16. Note that, from the viewpoint of further advantage in heat dissipation with dispersion and conduction of the heat from the first light sources 51, respectively, to mutually opposed side-wall portions 16S of the recess 16, preferably, the first light sources 51 are disposed such that the recess 16 as a storage space is interposed therebetween.

The number of second light sources 52 may be one or at least three. The second light sources 52 may be disposed at positions different from those according to each embodiment. Note that, from the viewpoint of further advantage in heat dissipation with conduction of the heat from the second light sources 52 to a side-wall portion 16S adjacent to the side-wall portions 16S of the recess 16 closer to the first light sources 51, preferably, the second light sources 52 are disposed side by side with the recess 16 in the second direction perpendicular to the first direction of connecting the first light sources 51 between which the recess 16 as a storage space is interposed.

The first light sources 51 and the second light sources 52 may be switched for lighting.

The recess 16 as a storage space is not necessarily unevenly located with respect to the center of the substrate 50. Note that, from the viewpoint of possible efficient arrangement of the light sources, preferably, the recess 16 is unevenly located along the second direction with respect to the center of the substrate 50. A light source may be disposed on the opposite side to the side on which the second light sources 52 are disposed with respect to the recess 16.

The electronic component 55 including no light source is not necessarily disposed at the position of the substrate 50 that overlaps the recess 16. From the viewpoint of the lamp according to the second aspect, a light source may be disposed at the position of the substrate 50 that overlaps the recess 16.

If the angle of divergence of the light from each second light source 52 requires no reducing, the lamp 1 may include no lenses 62.

The non-diffusion region 72 is not necessarily unevenly located with respect to the center of the outer cover 70. Note that, from the viewpoint of emission of the light emitted from each second light source 52 in the direction in which a location is uneven with respect to the center of the outer cover, preferably, the non-diffusion region 72 is unevenly located with respect to the center of the outer cover 70. Note that, even in a case where the non-diffusion region 72 is unevenly located with respect to the center of the outer cover 70, the direction in which the light from each second light source 52 is emitted from the outer cover 70 is not necessarily identical to the direction in which the non-diffusion region 72 is unevenly located with respect to the center of the outer cover 70.

The non-diffusion region 72 is not necessarily in contact with the outer circumference of the outer cover 70. Note that, in a case where the non-diffusion region 72 is unevenly located with respect to the center of the outer cover 70, from the viewpoint of inhibition of leakage of the light from each first light source 51 from the non-diffusion region 72 with an increase in the distance between each first light source 51 and the non-diffusion region 72, preferably, the non-diffusion region 72 is in contact with the outer circumference of the outer cover 70.

The direction of the optical axis of each lens 62 is not necessarily identical to the direction in which the light from the corresponding second light source 52 is emitted from the outer cover 70. That is, each lens 62 may be attached with a slight error and then the light from the second light source 52 may be emitted in any direction different from the direction of the optical axis of the lens 62.

The substrate on which the first light sources 51 are disposed may be different from the substrate on which the second light sources 52 are disposed. Note that, from the viewpoint of downsizing, preferably, the first light sources 51 and the second light sources 52 are disposed on a common substrate 50.

The area of the non-diffusion region 72 may be not less than the area of the diffusion region 71. Note that, from the viewpoint of emission of diffused light DL from a wide range, preferably, the diffusion region 71 is larger in area than the non-diffusion region 72.

From the viewpoint of the lamp according to the second aspect, the recess 16 as a storage space is not necessarily provided in the housing 10. Note that, from the viewpoint of inhibition of the surplus electric cable from protruding near the substrate 50 with housing of the electric cable 20 in the recess 16, preferably, the recess 16 is provided.

According to the first aspect of the present invention, provided is a lamp that enables downsizing with inhibition of deterioration in heat dissipation. According to the second aspect of the present invention, provided is a lamp that enables achievement of a wide range of illumination and locally high illumination and requires no upsizing. The lamps can be used, for example, in the technical field of illumination for a freight room in an aircraft and illumination for a vehicle.

REFERENCE SIGNS LIST

1 . . . lamp
10 . . . housing
11 . . . bottom wall
12 . . . side wall
16 . . . recess (storage)
20 . . . electric cable
22 . . . ground
40 . . . thermally conductive sheet
50 . . . substrate
51 . . . first light source
52 . . . second light source
60 . . . lens unit
62 . . . lens
70 . . . outer cover
71 . . . diffusion region
72 . . . non-diffusion region
80 . . . holder

The invention claimed is:

1. A lamp comprising:
a light source;
a substrate on which the light source is disposed;
a housing in which the substrate is disposed;
an electric cable connected to the substrate, the electric cable extending outward from the housing; and
a thermally conductive sheet having elasticity, the thermally conductive sheet being sandwiched by a region in which the light source is disposed on the substrate and a bottom wall of the housing, wherein
the bottom wall of the housing has a storage space which is a recess and in which the electric cable is housed, at a position overlapping part of the substrate out of the region in which the light source is disposed.

2. The lamp according to claim 1, wherein
the housing is made of metal,
the electric cable includes a ground, and
the ground is connected to the housing in the storage space.

3. The lamp according to claim 1, further comprising:
an outer cover optically transparent, the outer cover covering at least the light source; and a holder secured to the housing, the holder having the outer cover secured to the holder, wherein the holder is made of metal.

4. The lamp according to claim 1, wherein the light source includes a plurality of first light sources, and the plurality of first light sources is disposed at least in pairs on the substrate such that the storage space is interposed between the plurality of first light sources.

5. The lamp according to claim 4, wherein the light source includes at least one second light source, and the at least one second light source is disposed at least on one side of the substrate with respect to the storage space in a second direction perpendicular to a first direction of connecting the first light sources between which the storage space is interposed.

6. The lamp according to claim 5, wherein the storage space is unevenly located on another side of a center of the substrate in the second direction, and the light source is not disposed on another side of the substrate with respect to the storage space in the second direction.

7. The lamp according to claim 1, wherein an electronic component different from the light source is disposed, on the substrate, at a position overlapping the storage space.

8. A lamp comprising:

a first light source and a second light source;

a housing in which the first light source and the second light source are disposed;

an outer cover optically transparent, the outer cover being secured to the housing, the outer cover covering the first light source and the second light source; and a lens that reduces an angle of divergence of light to be transmitted, wherein the outer cover is provided with a diffusion region that diffuses light to be transmitted and a non-diffusion region that inhibits diffusion of light to be transmitted, light emitted from the first light source is emitted through the diffusion region, and light emitted from the second light source is emitted through the lens and the non-diffusion region.

9. The lamp according to claim 8, wherein lighting of the first light source and lighting of the second light source are performed simultaneously.

10. The lamp according to claim 8, wherein the non-diffusion region is unevenly located with respect to a center of the outer cover, and a direction in which the light from the second light source is emitted from the outer cover is identical to a direction in which the non-diffusion region is unevenly located with respect to the center of the outer cover.

11. The lamp according to claim 10, wherein the non-diffusion region is provided in contact with an outer circumference of the outer cover.

12. The lamp according to claim 10, wherein a direction of an optical axis of the lens is identical to the direction in which the light from the second light source is emitted from the outer cover.

13. The lamp according to claim 8, wherein the first light source and the second light source are disposed on a common substrate.

14. The lamp according to claim 8, wherein the diffusion region is larger in area than the non-diffusion region.

15. The lamp according to claim 8, wherein the lens is disposed closer to the second light source than the outer cover is.

16. The lamp according to claim 8, wherein the lens is integrated with the non-diffusion region of the outer cover.

* * * * *